United States Patent [19]

Bullen et al.

[11] 4,445,881

[45] May 1, 1984

[54] METHOD AND APPARATUS FOR IMPROVING NEWSPAPER FOLDING AND CUTTING MECHANISMS

[75] Inventors: Lee Bullen, Carrollton, Tex.; Carl J. Hermach, Gulfport, Fla.

[73] Assignee: Publishers Equipment Corporation, Carrollton, Tex.

[21] Appl. No.: 363,900

[22] Filed: Mar. 31, 1982

[51] Int. Cl.[3] ..... B65H 45/16; B42C 1/04

[52] U.S. Cl. ..... 493/424; 270/50; 270/60; 493/427; 493/432

[58] Field of Search ..... 493/424–435; 270/60, 42, 47–50, 38

[56] References Cited

U.S. PATENT DOCUMENTS

| | | | |
|---|---|---|---|
| 955,367 | 4/1910 | Spalckhaver | 493/429 X |
| 1,626,592 | 5/1927 | Andersen | 270/50 |
| 2,985,449 | 5/1961 | Dietrich | 493/431 X |
| 3,263,988 | 8/1966 | Heimlicher | 270/50 |

FOREIGN PATENT DOCUMENTS

| | | | |
|---|---|---|---|
| 217099 | 6/1924 | United Kingdom | 493/431 |

*Primary Examiner*—A. J. Heinz

*Attorney, Agent, or Firm*—Robert V. Jambor

[57] ABSTRACT

An improvement in the method and apparatus for folding newspaper in the "collect" mode. Inside and outside web sections are printed with the same number of lines and transferred to a folding cylinder which collects them in overlapping relation. Expanding means incorporated in the body of the cylinder expand its effective radius to permit the trailing edge of the outside section to be cut to a length equal to that of the inside section without recutting the inside section. The collected sections are then passed through second fold rollers for final folding.

6 Claims, 5 Drawing Figures

METHOD AND APPARATUS FOR IMPROVING NEWSPAPER FOLDING AND CUTTING MECHANISMS

BACKGROUND OF THE INVENTION

The cost of printing newspapers is, in part, a function of the number of lines which can be printed on a page. This cost could be reduced if additional lines (of the same print) could be printed on a page of paper of a specified size. Alternatively, revenues from classified advertising could be increased if additional lines could be printed on the same size of page.

We have discovered that presently available equipment and printing methods do not minimize this cost nor maximize the potential revenues. Such equipment is, in part, illustrated by U.S. Pat. No. 3,038,719 which issued to L. S. Tyma, Jr. in 1962. This patent discloses a mechanism for cutting and folding the printed paper in either a "straight" mode or in the "collect" mode. Operation of this type of machine in the "collect" mode imposes constraints on the printer which preclude minimizing cost and maximizing revenues.

Such constraints can be pictorialized by considering the cutting and folding operation of the mechanism of Tyma. "Collect" mode operation is shown schematically in FIG. 1. A printed paper web 10 is fed to the folding and cutting mechanism 12 from the presses. The mechanism 12 comprises a cutting cylinder 14, folding cylinder 16 and second fold rollers 18. The folding cylinder 16 carries pins 20, 22, and 24 which pick up the leading edge of each section of the web 10. Cutting blades 26 and 28 of the cutting cylinder sever the web 10 into sections. Tucking blades 30 within the forming cylinder 16 will, at appropriate times, tuck the collected sections into folding rollers 18.

Operation of the mechanism 12 in this "collect" mode requires no adjustment to the Tyma mechanism. At least one of the cutting blades 26 is relocated about the periphery of the cutting cylinder 14 a short distance—usually about a quarter of an inch. This relocation results in the cutting of a short inside section and a longer outside section. Importantly, this relocation insures that the trailing edge of the inside section will not be cut a second time when the cutting blade 28 severs the outside web section. This result can be seen in FIG. 1 which discloses that the trailing edge of the inside section is shorter than the outside section and will not be resevered by cutting blade 28 as it severs the outside section. Such repositioning of at least one of the cutting blades 26 has been regarded as necessary to avoid shredding of the the trailing edge of the inside section and proper cutting of the outside section. Shims are provided with the cutting cylinder to facilitate the illustrated adjustment of blade 26.

But operation of the mechanism 12 in the "collect" mode requires more than an adjustment to one of the cutting blades. The printer must anticipate a shorter inside section and reduce the number of printed lines on all of its pages. Hence, costs are increased; revenues are decreased.

SUMMARY OF THE INVENTION

Our invention is, in part, recognition that the cost and revenues resulting from accepted printing methods and equipment can be enhanced. In addition, our invention includes simple, effective devices which permit the cost to be reduced and the revenue to be increased. More specifically, our invention includes 1. a method for printing a greater number of lines on the inside section of a newspaper;
2. a method for cutting the outside section of the paper while avoiding recutting of the inside section; and
3. simple mechanical means for expanding the radius of each section of the folding cylinder to remove each inside section from under the second cutting blade upon cutting the outside section.

DESCRIPTION OF THE DRAWINGS

The methods and designs of our invention, together with their advantages are fully described in the following specifications and drawings in which.

DETAILED DESCRIPTION

In practicing our invention, the printers will disregard their prior procedure of reducing the number of printed lines on the inside section of the web. Each printing plate will contain the same number of lines and each page will be of the same length. When the newsprint is prepared in this manner, costs are decreased, revenues increased—if the inside and outside sections are severed in equal lengths.

To obtain sections of equal lengths, our invention contemplates that the cutting blades will be positioned 180° apart on the cutting cylinder. In spite of this repositioning of the cutting blades, the outside section can be severed without recutting the inside section. This is accomplished by expanding the effective radius of the section of the folding cylinder on which the two sections are collected.

Figure 3:
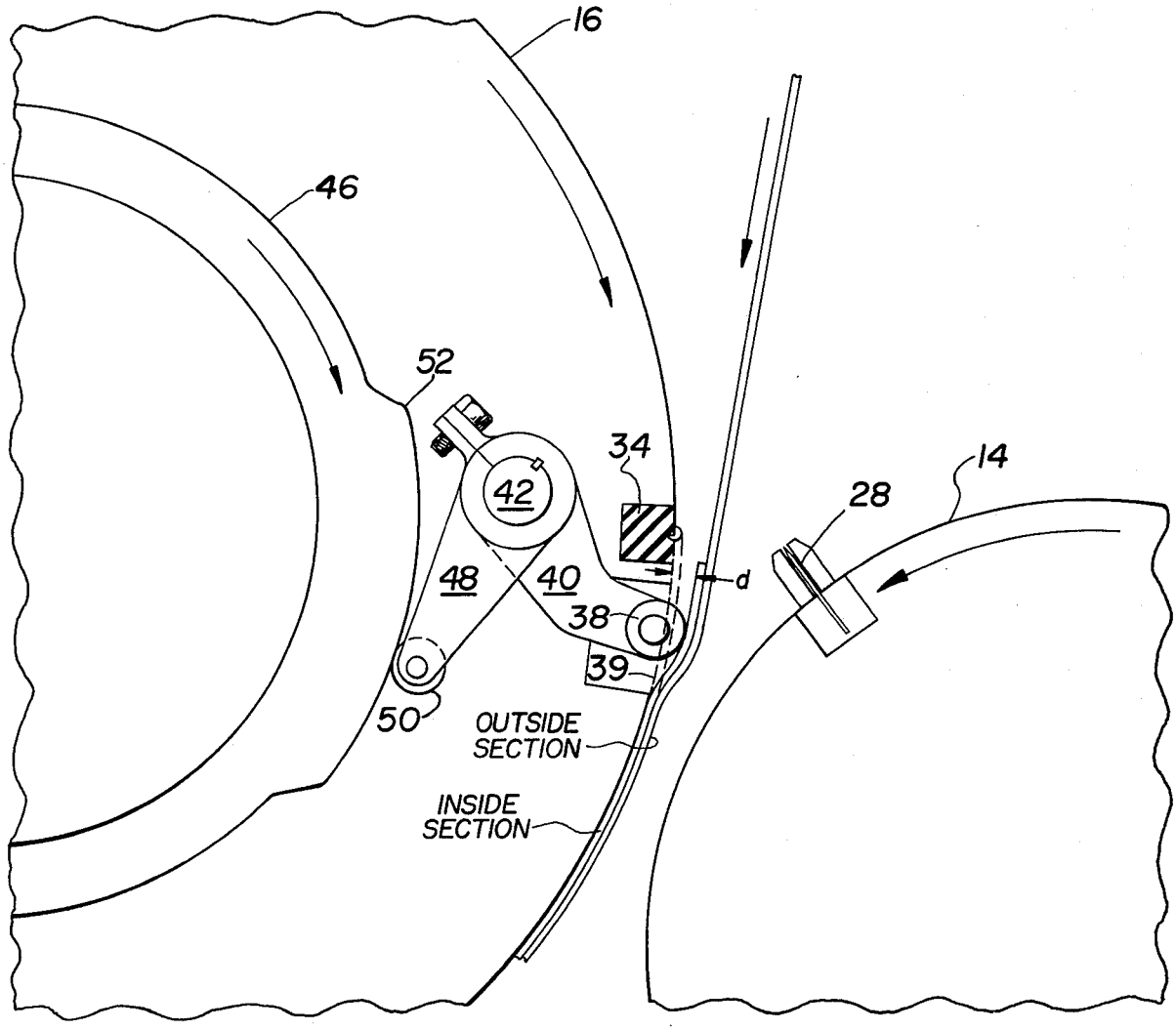
FIG. 3 is a side elevational view taken along the lines 3—3 of FIG. 2.

This expanding operation is depicted in FIG. 3. An inside and outside section of newspaper web has been collected on the lower one-third of the folding cylinder. The outside section is about to be severed by the blade 28 of the cutting cylinder 14. However, just prior to the engagement of blade 28 with the outside section and the resilient cutting pad 34, the effective radius of the folding drum 16 is expanded. And such expansion lifts the trailing edge of the inside section a distance "d" from its normal position on the cylinder. Such lifting action withdraws the trailing edge from under the path of the cutting blade 28. Thus, the trailing edge is not recut.

Figure 1:
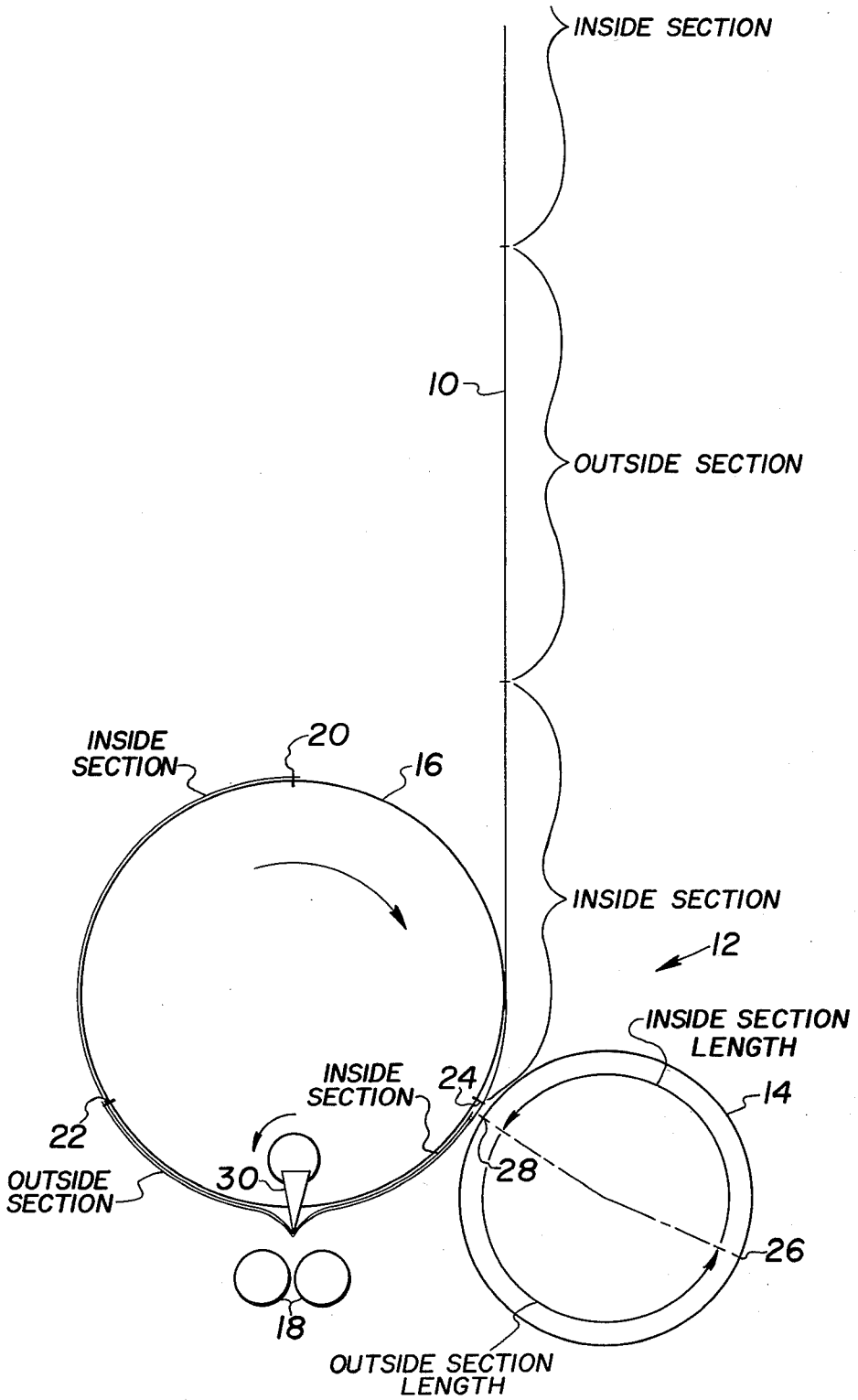
FIG. 1 is a schematic illustration of the cutting and folding mechanism of the prior art.
Figure 2:
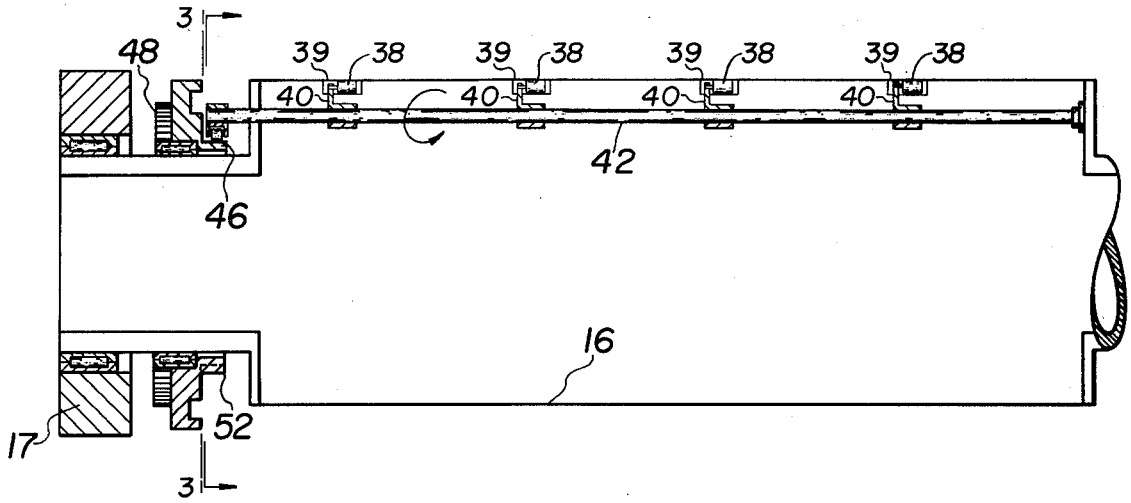
FIG. 2 is a schematic elevational view depicting, in section, one embodiment of my invention in association with the folding cylinder.

Alternative devices for carrying out this process are depicted in FIGS. 2–5 of which FIGS. 2 and 3 disclose my preferred embodiment. Each embodiment is illustrated with reference to a folding cylinder of a construction similar to that of the Tyma patent. There, the folding cylinder 16 is journaled in supporting members 17 (only one of which is shown) and rotatably driven as described by Tyma. To expand the effective radius of each collecting section of the cylinder, the preferred embodiment includes a plurality of spaced apart rollers 38. These rollers 38 are normally recessed within the folding cylinder 16. However, to increase the effective radius of the cylinder, they are cammed outwardly through opening in the wall of cylinder 16 at a time just prior to cutting the trailing edge of the outside section.

This camming action is effected by a cam arrangement mounted outside of the folding cylinder. Each roller 38 is mounted on a crank arm 40 which is constrained for rotation with a pivotal shaft 42 mounted within the folding cylinder. This pivotal shaft 42 is operated by a rotatable cam 46 through a crank arm 48 having a roller 50 which engages the cam 46. This cam 46 is journaled on the hub of folding cylinder 16 and is driven relative to this cylinder by a separate gear 48. Relative rotation between the cam 46 and the folding cylinder 16 will cause the lobe 52 of the cam to contact roller 50 of crank arm 48 and effect the radial movement of rollers 38. Such expands the effective radius of the folding cylinder 16 and lifts the web sections off the cylinder surface. Such lifting action, as previously explained, withdraws the inside section from the path of cutting blade 28, and only the outside section is severed.

Since the folding cylinder 16 has three collecting sections, three pivotal shaft assemblies will be mounted in the cylinder 16. Each can be actuated by the cam 46.

Those familiar with the "collect" mode of forming newspapers will recognize that the rollers 38 of each section are expanded and retracted once every two revolutions of the folding cylinder 16. Such actuation occurs in the same cycle as actuation of the pins which pierce the leading edge of each inside section. For this reason, the cam 46 may be affixed to, or made an integral part of the cam device which actuates the conventional pin shafts. For example, the Tyma patent (FIG. 3) discloses a rotating cam for the pin shaft of the folding cylinder (unnumbered). This cam is driven by a gear which meshes with a gear of the cutting cylinder of his machine, the gears having a 1:1 ratio. If cam 46 is affixed to the pin shaft cam, or made a part of the pin shaft cam, expansion of the rollers 38 will be properly synchronized with the rotation of the cylinder.

Figure 4:
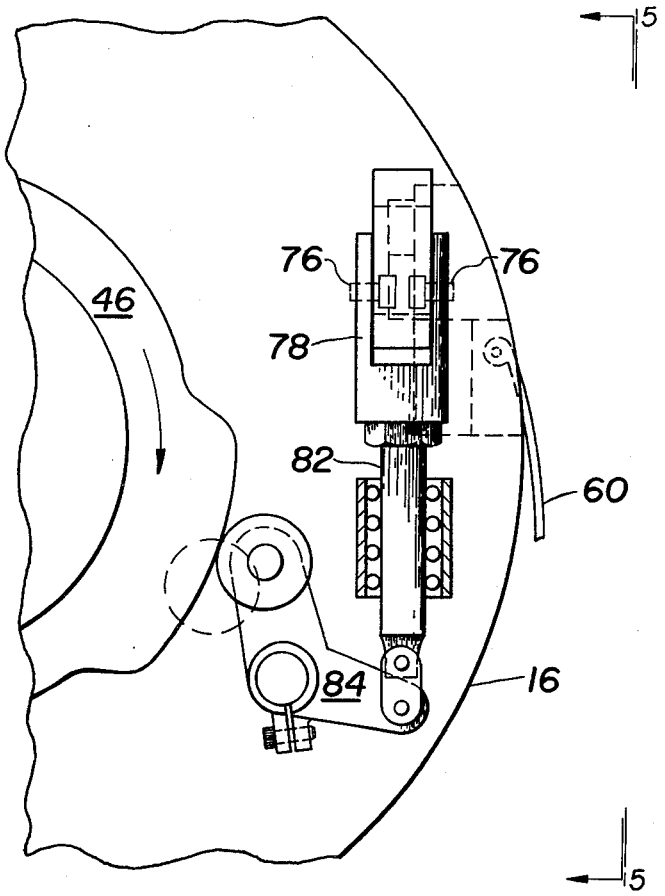
FIG. 4 is a side elevational view of another embodiment of my invention as viewed along the lines 3—3 of the folding cylinder of FIG. 2.
Figure 5:
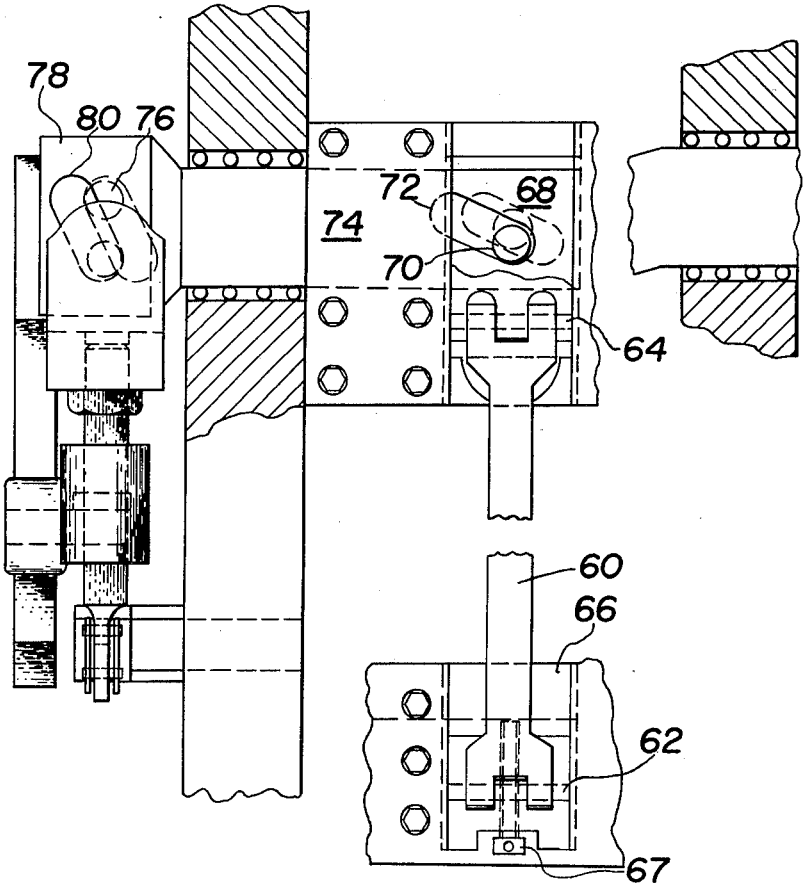
FIG. 5 is a front elevational view of the embodiment of FIG. 4 with portions of the folding cylinder supports broken away.

The second embodiment of our invention is depicted in FIGS. 4 and 5. This embodiment utilizes a plurality of bands 69 spaced apart upon each collecting section of the cylinder 16. These bands 60 are hinged at each end by pins 62, 64 passing through the ends and into anchor blocks 66, 68 affixed to the cylinder 16. Conventional type adjusting screws 67 may be used in conjunction with the pins at one end to adjust the arc of the bands 60 in its unextended position. For example, see U.S. Pat. No. 3,477,709.

Intermittent radial extension or bowing of the bands 60 is the method of extending the effective radius of the folding cylinder 16 in this embodiment. Such is effected by moving the upper end of the bands (as viewed in FIG. 5) towards the lower ends.

For this purpose, the upper anchor blocks 68 are movable within slots formed within the cylinder. Each block 68 includes a pin 70 which extends into a cam slot 72 formed in a slide bar 74.

As the slide bar 74 is reciprocated to the left, the bands 60 are caused to bow outwardly, thus increasing the effective diameter of the folding drum; lifting off the collected inside and outside sections; and retracting the inside section from the path of the cutting blade 26.

The slide bar 74 is reciprocated by cam pins 76 which extend from a clevis 78 into a slot 80 milled into the slide bar. A connecting rod 82 connects the clevis 78 to a bell crank 84 pivotally mounted on a vertical end wall (unnumbered) of cylinder 16. The bell crank 84 engages cam 46 which is operated in the manner described in reference to the embodiment of FIGS. 2 and 3.

Again reference may be had to the Tyma patent for consideration of the details of the synchronization of the expansion of the bands 60 with cutting of the outside section. Similarly, further details of the entire folding and cutting mechanism (not essential to an understanding of our invention) may be obtained from that patent whose disclosure is incorporated as if fully set forth herein.

Those skilled in the art will appreciate that our invention may take various forms and that several modifications may be made. For example, return springs may be affixed to each of the cam follower devices to insure that, until positively actuated, the radius expanding means will remain within the plane of the folding cylinder. The effective radius of the folding cylinder might be expanded by other mechanical, hydraulic, or pneumatic means. Similarly those familiar with the art will appreciate the beneficial results of our invention. Upon increasing the length of the inside section, by at least one-quarter inch, printing space is made available. Such permits, for example, the printing of at least three additional lines of classified advertisements which are usually printed at 14 lines per vertical inch.

We claim:

1. In a folding and cutting mechanism for collecting, cutting and folding at least two web sections of a paper, the improvement comprising a. a folding cylinder for receiving at least two web sections, an inner section and an outer section, one upon the other;

b. a cutting cylinder having blades for cutting the web sections into substantially equal lengths; and c. intermittent expansion means within the folding cylinder having a first position and a second position, the effective radius of said folding cylinder being larger when said intermittent expansion means is in said second position than is said radius when said intermittent expansion means is in said first position, means for moving said intermittent expansion means between said first and second positions, said intermittent expansion means being disposed in said first position when said cutting blades are disposed to cut an inner web section from said web and disposed in said second position when said cutting blades are disposed to cut an outer section from said web, said positioning of said intermittent expansion means in said second position being adapted to lift the web sections off of the cylinder moving the previously cut end of the inner section a distance along the circumference of the cylinder thereby withdrawing the inner section from the path of the blades of the cutting cylinder.

2. A mechanism as recited in claim 1 in which said expansion means are actuated by mechanical cams.

3. A mechanism as recited in claim 2 in which said mechanism includes a. a shaft mounted within the folding cylinder for rotational movement relative to said folding cylinder;

b. crank arms spaced apart on said shaft and extending toward the circumference of the cylinder; and c. at least one crank arm constrained for rotation with said shaft and engaging said mechanical cam to act as a cam follower and rotate said spaced apart crank arms to extend the effective radius of said cylinder.

4. In a folding and cutting mechanism for collecting, cutting and folding at least two web sections of a paper, the improvement comprising a. a folding cylinder for receiving at least two web sections, one upon the other;

b. a cutting cylinder having blades for cutting the web sections into equal lengths; and c. intermittent expansion means within the folding cylinder for expanding the effective radius of the cylinder, said means capable of lifting the web sections off of the cylinder and withdrawing the inner section from the path of the blades of the cutting cylinder and said expansion means are actuated by mechanical cams d. spaced apart flexible bands are pivotally affixed to the folding cylinder one end of each band being mounted upon anchor blocks slidable with respect to said folding cylinder;

e. horizontally mounted slide bar means carried by said folding cylinder and in camming engagement with said bands for intermittently flexing said bands outwardly, said bar including cam slots formed therein overlying each one of said slidable anchor blocks, each of said anchor blocks including a pin affixed thereto disposed in one of said cam slots;

f. means interconnecting said slide bar with said mechanical cam for intermittently reciprocating said slide bar to slide said slidable anchor blocks.

5. A mechanism as recited in claim 4 in which said interconnecting means includes a bell crank pivotally mounted on said folding cylinder and having one arm engaging said mechanical cam and the other engaging said slide bar.

6. In a folding cylinder for a newspaper folder, the improvement comprising a. expansion means for intermittently increasing the effective radius of a section of the cylinder;

b. actuating means for intermittently actuating said expansion means only after said folding cylinder has collected an inside section and an outside section;

c. spaced apart flexible bands which are pivotally affixed to the folding cylinder, one end of each band being mounted upon anchor blocks slidable with respect to said folding cylinder;

d. horizontally mounted slide bar means carried by said folding cylinder and in camming engagement with said bands for intermittently flexing said bands outwardly, said bar including cam slots formed therein overlying each one of said slidable anchor blocks, each of said anchor blocks including a pin affixed thereto disposed in one of said cam slots;

e. means interconnecting said slide bar with said mechanical cam for intermittently reciprocating said slide bar to slide said slidable anchor blocks.

* * * * *